United States Patent [19]

Von Kohorn

[11] 4,381,109

[45] Apr. 26, 1983

[54] CONDUCTIVE BALL

[76] Inventor: Henry Von Kohorn, 22 Perkins Rd., Greenwich, Conn. 06830

[21] Appl. No.: 288,219

[22] Filed: Jul. 29, 1981

[51] Int. Cl.[3] ..... A63B 61/00

[52] U.S. Cl. ..... 273/61 R; 40/327

[58] Field of Search ..... 273/61 R, 61 B, 58 G, 273/58 K, 61 C, 61 D; 40/327

[56] References Cited

U.S. PATENT DOCUMENTS

| | | | |
|---|---|---|---|
| 3,854,719 | 12/1974 | Supran | 273/61 R |
| 3,883,860 | 5/1975 | Kohorn | 273/61 R X |
| 4,092,634 | 5/1978 | Kohorn | 273/61 B |
| 4,299,029 | 11/1981 | van Auken | 273/61 R |
| 4,299,384 | 11/1981 | van Auken | 273/61 R |

*Primary Examiner*—George J. Marlo

[57] ABSTRACT

A ball, for use in ball game indicating systems which comprise spaced electric ground leads as part of a circuit intended to be closed by an impacting ball having conductive adhesive, seams, and surface elements, such ball having requisite electric conductivity and high visibility in flight, wherein a. at least 75% of the playing surface of the ball is light colored, and b. a plurality of separate elements forming spaced electric leads have been provided on not more than 25% of the playing surface of the ball, said electric leads i. comprising a dark-colored, finely divided electrically conductive substance, ii. having defined shape and a width of at least 2 millimeters, iii. being spaced so that on the playing surface of the ball no lead is separated from the next nearest lead by more than 20 millimeters, and iv. having overall dimensions so that leads on the playing surface of the ball touching the ground connect two ground leads at the moment of impact of the ball.

16 Claims, 2 Drawing Figures

CONDUCTIVE BALL

BACKGROUND OF THE INVENTION

I. Field of the Invention

This invention relates to electrically conductive, highly visible balls, and particularly to tennis balls used in systems comprising circuits formed by conductive elements on or adjacent to the court playing areas and capable of activating visual and audible indicators when closed by such a ball dropping on a line which is part of the court, or dropping outside the playing area. While the present invention may be employed in the manufacture of different types of balls for other games, references herein will be made primarily to conventional tennis balls, although such reference is meant to include balls for other games as well.

II. Description of the Prior Art

The prior art discloses a number of efforts to provide court and all game indicating systems, such as for tennis, in which players, spectators and umpires are able to determine accurately by visual or audio means, or both, whether or not a ball drops, i.e. touches the ground, within or outside the designated playing area. Such a system is disclosed in Swedish Pat. No. 206,864 to Johansson. Other, improved systems are described in applicant's U.S. Pat. Nos. 3,883,860 and 4,092,634. In these systems, parts of the playing areas, such as the lines, and the areas outside the lines defining the in-bounds playing area, have thereon electric leads, which leads are part of a circuit which is closed by an electrically conductive ball coming in contact with two or more such electric leads. However, past efforts to make balls sufficiently electrically conductive to close such circuits have had the serious disadvantages of either resulting in balls with unacceptable playing characteristics or with poor in-flight visibility, due to discoloration caused by the dark color of the substances used to impart electric conductivity to the balls.

An electrically conductive ball is disclosed by Supran, U.S. Pat. No. 3,854,719; this ball has steel wire or staple sliver steel uniformly woven into the cover cloth panels. However, steel or any other metal fibers, due to their stiffness and high specific gravity, impart highly altered and completely unacceptable playing characteristics to tennis balls. Supran also mentions spraying or otherwise applying electrically conductive paint onto the outer surface of the ball. Applicant is not aware of any conductive paint which, when sprayed onto the entire surface of a ball, will not excessively discolor the ball, i.e. diminish its visibility in flight, nor change its playing characteristics to an unacceptable degree. The use of conductive substances, such as carbon black or carbon fibers to make textile products electrically conductive for purposes of dissipating static electric charges has been suggested by Hotta et al. U.S. Pat. No. 3,746,573 and by Fujiwara et al. U.S. Pat. No. 3,708,335. However, the recommended amounts of such conductive materials are very small, as relatively large amounts would discolor the products to an unacceptable degree; the conductivity of textile products thus produced is inadequate for the contemplated purpose.

It therefore is an object of this invention to provide balls for use in ball game indicating systems.

It also is an object to provide balls for use in court and ball game indicating systems, such as are described in applicant's U.S. Pat. No. 4,092,634.

It is another object of the present invention to provide electrically conductive balls, such as tennis balls having normal playing characteristics.

It is yet another object to provide electrically conductive balls, such as tennis balls, comprising on their playing surface conductive substances darker in color than the rest of the ball surface, said balls nevertheless having unimpaired visibility in flight.

It also is an object to change the disadvantage hitherto associated with the use of discoloring, conductive substances to the advantage gained by improving ball visibility by using conductive discolorants in the manner set forth.

SUMMARY OF THE INVENTION

I have discovered that it is possible to produce a ball, such as a tennis ball with a diameter of 60–68 millimeters, having satisfactory electric conductivity to be used in court and ball game indicating systems, normal playing characteristics and improved or at least unimpared visibility in flight, if a. at least 75% of the playing surface of the ball is light-colored, and b. a plurality of separate elements forming spaced electric leads have been provided on not more than 25% of the playing surface of the ball, said electric leads i. comprising a dark-colored, finely divided electrically conductive substance, ii. having a defined shape and a width of at least 2 millimeters.

iii. being spaced so that on the playing surface of the ball no lead is separated from the next nearest lead by more than 20 millimeters, and having overall dimensions so that leads on the playing surface touching the ground connect two electric ground leads at the moment of impact of the ball.

Balls meeting these requirements for use in systems such as described in U.S. Pat. No. 4,092,634, may be made in a variety of ways, including particularly the cementing of two cloth panels to a core ball or practiced in the manufacture of conventional tennis balls. In such balls it is important that the electric leads on the surface of the ball which make contact with the ground are interconnected in order to ensure the closing of the electric circuit of which the ball is a part. The electric leads may be interconnected on or below the outer or playing surface of the cloth panel cover.

According to a preferred embodiment, the individual leads have configurations enabling one lead to span the gap between two ground leads. The term "ground leads" as used herein refers to ground leads of opposite charge. According to another preferred embodiment, the endless seam between two panels forming the cover is electrically conductive and interconnects the electric leads on the ball playing surface.

DETAILED DESCRIPTION OF THE INVENTION

Figure 1:
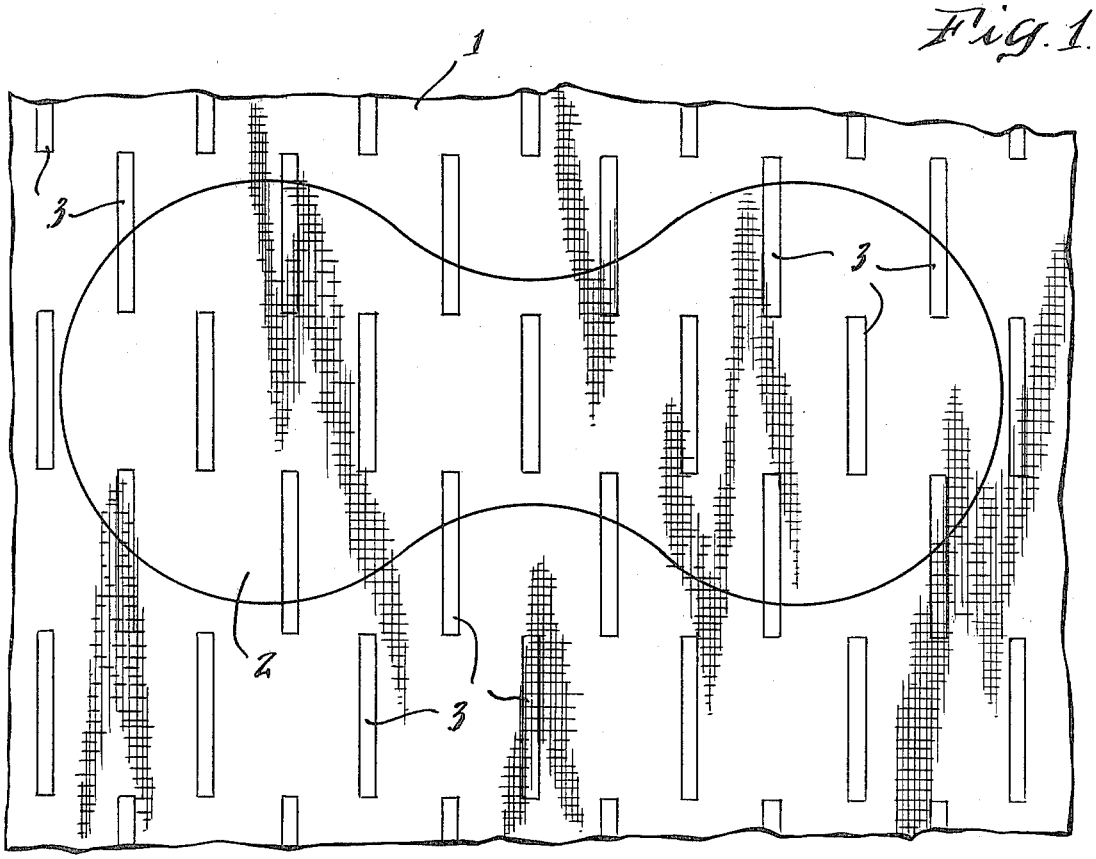
FIG. 1 shows a section of a ball cover having electric leads on its surface from which the panels forming the ball playing surface will be cut.

Balls suitable for use in systems, such as described in applicant's U.S. Pat. No. 4,092,634, must, inter alia, have the following properties: 1. Satisfactory conductivity, 2. normal playing characteristics, and 3. unimpared visibility in flight.

The use of the most highly electrically conductive materials such as carbon and graphite fibers, blended in sufficient proportions with conventional fibers, such as wool, nylon and polyester commonly used in ball covers, has the disadvantage of excessively discoloring the ball and impairing its visibility in flight, due to the color of the conductive fibers. By "discoloring" is meant the effect, not only of black, but of any color which, if obtaining on more than 25% of the ball surface, impairs the visibility of the ball in flight. The term "dark-colored" as used herein is intended to apply to any color shade or value having such a discoloring effect.

This also applies to conventional fibers coated with resins containing electrically conductive substances, which tend to uniformly discolor the ball cover fabric. The present invention avoids this problem by making only discrete or defined areas of the ball surface conductive; such areas totalling not more than 25% of the ball surface.

On the other hand, the use suggested by Supran of light-colored, conductive metal fibers in the cover of balls results in altered playing characteristics which are not acceptable in normal play. Although the present invention contemplates the use of conductive metals in finely divided form for use in pastes or fluids, it specifically excludes the weaving of metal wire or the blending of metal fibers into the fibrous panels covering the ball, thereby avoiding the said drawbacks.

Balls which are sufficiently electrically conductive to be used in the aforementioned systems and having both normal playing characteristics and excellent visibility can be manufactured in a manner not requiring that the entire surface of the ball be conductive, provided they meet certain prerequisites. Balls having on their surface defined or discrete, spaced, electrically conductive leads or elements having a dark color are entirely satisfactory, provided the leads are at no point separated by more than 20 millimeters of non-conductive surface. In this manner, no point on the ball is separated by more than 10 millimeters from the nearest electric lead. Significantly larger separations may prevent the closing of the electric circuits of which the ball is a part. The leads normally have a width of 2–8 millimeters, preferably 3–6 millimeters, and normally are evenly spaced. A width of less than 2 millimeters may not ensure the closing of the electric circuit. If the leads which tend to discolor the playing surface are wider than 10 millimeters, or are spaced too closely, they will occupy too large a percentage of the ball surface area and tend to impair or destroy the visibility of the ball. The cumulative surface area of all elements or leads having a relatively dark color therefore must not exceed approximately 25% of the playing surface of the ball to preserve good ball visibility in flight. In fact, balls having dark-colored markings of the kind described, will in many instances have visibility in flight, to players and spectators alike, which is superior to that of a uniformly light-colored ball. The dark-colored areas, i.e. the electrically conductive elements are provided on the panel fabric as set forth hereinafter.

The balance of 75% of the playing surface consists, in the case of tennis balls, of conventional fabric made by weaving, knitting, felting or the like, conventionally shaped, cut and cemented or glued to core balls.

In the drawings, FIG. 1 depicts a section of the fibrous cover cloth 1 of a tennis or similar ball, from which panel 2 will be cut. Prior to cutting panel 2, elements 3 in the shape of solid or hollow rectangles have been applied in staggered relationship to the cover cloth 1. Alternatively, such rectangles or lines can intersect. The elements 3 comprising an electrically conductive substance have been applied in fluid form and under sufficient pressure to penetrate cover cloth 1. When the fluid has dried, it forms electric leads on both sides of the cut panel 2, said leads having the staggered relationship shown. The leads are electrically interconnected by an electrically conductive, adhesive layer cementing panel 2 to the core ball. The solid or hollow elements 3 are twenty millimeters long, have an overall width of five millimeters and are spaced twenty millimeters apart, so that upon contact with the ground no point on the tennis ball surface will be separated by more than ten millimeters from one of the electric leads formed by elements 3.

Figure 2:
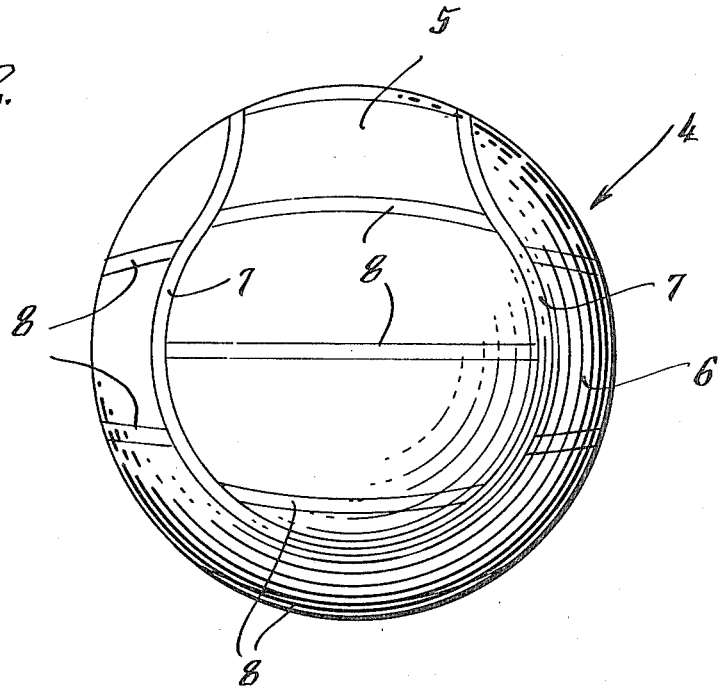
FIG. 2 shows a tennis ball having on its surface electric leads interconnected by an electrically conductive seam between the cover cloth panels.

FIG. 2 depicts a tennis ball 4 comprising a core ball (not shown) to which fibrous panels 5 and 6 have been cemented with an adhesive. Penels 5 and 6 are joined by seam 7, which is three millimeters wide and has been made conductive by admixing an electrically conductive, finely divided substance to the adhesive. Lines 8, which may be solid or hollow, are three millimeters wide and are spaced twenty millimeters apart, comprise an electrically conductive ink or other substance. They have been printed and dried on panels 5 and 6, and extend to and contact seam 7, thus forming the electric leads of a conductive network on the surface of tennis ball 4. If the electric leads on the ground are spaced twenty millimeters apart, no electric lead on the playing surface of such a ball is farther than ten millimeters apart from an electric lead on the ground. Preferably, the adhesive cementing panels 5 and 6 to the core ball also is conductive, and conductive seam 7 consists of the same adhesive/conductive composite. The spacing and the width of the electric leads are chosen so that the ball falling to the ground closes the circuit of which the ground leads are a part.

It will be apparent from the abovementioned description that, in order to ensure satisfactory conductivity, playing characteristics and visibility, a delicate balance of properties is essential and the range of manufacturing specifications is fairly narrow and must be carefully observed.

Carbon fibers developed in recent years, such as those manufactured and sold by Union Carbide Corporation under the Ucar and Thornel trademarks, are available as very thin and pliable, black fibers capable of being woven, as well as felted. Their lack of stiffness sets them apart from metal fibers and their specific gravity of 1.8–2.0, which is a fraction of that of steel and not much higher than that of some man-made textile fibers, permit their use in tennis ball covers on a limited scale in accordance with the present invention.

In the case of carbon-based continuous filament yarns having textile fiber properties, this is accomplished by weaving, knitting or otherwise incorporating the electrically conductive yarns into the ball cover in such a way that these elements appear on the ball surface intermittently and do not cover more than approximately 25% of the ball surface. They normally take the form of a plurality of small or discrete, spaced, electric leads on the ball surface and are interconnected solely on the inner surface of the cover cloth. In addition, these continuous filament yarns may be embedded on the inner surface of the panel facing the core ball in an electrically conductive, adhesive coating cementing the panels to the core ball. The electric leads may also consist of discrete, discontinuous, electrically conductive, carbon-based fiber tufts or bundles which have textile fiber properties and which have been inserted into the non-conductive fibrous web. Said conductive elements or leads are not electrically connected on the surface of the ball. According to one embodiment of the ball construction, discrete electrically conductive carbon fiber tufts or bundles are needle-punched or hooked into the ball cover from, and sheared off so as to be flush with, the playing surface prior to cutting the fabric into panels; they penetrate the entire thickness of the cover cloth, so as to contact the electrically conductive, adhesive layer or coating which cements or glues the cover panels to the core ball. Said layer or coating serves to interconnect the discrete electric leads exposed on the ball surface solely on the inner surface of the ball cover.

Alternatively, the electrically conductive elements forming said leads may consist of a paste, liquid or other electrically conductive substance inserted into and through the fibrous web in fluid form and subsequently set, dried or cured. While in fluid form, said substance may coat some of the fibers or yarns forming the web, particularly those surrounding the electric elements. Such pastes or liquids may, for instance, contain finely divided carbon, silver or other electrically conductive substance in combination with a polymeric binder. These composite substances are applied on the outer or playing surface of the fabric and normally applied in fluid form and set or cured so as to provide solid electric leads or connectors. The conductive elements shaped as set forth herein and forming the electric leads or connectors, are exposed on the surface of the ball and may themselves be electrically interconnected on or below the playing surface of the ball cover panels; in that event, the adhesive layer on the core ball need not be conductive. However, according to a preferred embodiment, the adhesive layer which cements the ball cover panels to the core ball has added to it an electrically conductive substance so that the electric surface leads are interconnected both directly and through said layer.

The outer layer forming the playing surface of balls, other than tennis balls, may consist of any suitable material, including film or coating of sufficient thickness to permit providing said electric leads on the playing surface of such layer, while permitting the electrically conductive elements penetrating said layer and forming said leads to be interconnected on the inner surface of said layer.

In the case of tennis balls, the conductive material in other than fiber form, is normally deposited on the fibrous web in fluid form prior to cutting the web into panels, but it may also be deposited directly on the cut panels or on the ball. It may be deposited on the fibrous substrate by printing, spraying, painting, coating or other methods. The conductive elements may take the shape of lines and other elongated configurations, rectangles, rings, or any other solid or hollow two-dimensional geometric shapes. They may be in the form of crossed and/or discontinuous lines, or endless lines encircling the ball similar to the circles on a globe corresponding to the meridians or the circles corresponding to degrees latitude. They may also be curved lines or lines paralleling the seam between the panels forming the cover. In all instances, however, the elements forming the electric leads on the surface of a tennis ball should meet the following eightfold requirements. They must 1. have sufficient conductivity;
2. be defined or distinct, and have a spaced relationship;
3. have a width not exceeding approximately 8 millimeters;
4. be spaced on the playing surface so that no point on said leads is separated from the next nearest lead by more than approximately 20 millimeters;
5. collectively cover not more than approximately 25% of the ball surface;
6. be either electrically interconnected, or extend sufficiently on the surface of the ball so as to bridge the distance between two electric leads on the ground contacted by the flattened surface of the ball impacting on the ground;
7. have physical properties that do not alter the normal playing characteristics of the ball; and
8. improve or at least not impair the visibility of the ball in flight.

If these conditions are met, electrically conductive, non-metallic filaments, fibers and yarn of dark color, or other discoloring electrically conductive substances may be used as the leads or conductors on the ball surface.

I also have discovered that the seam between the panels forming the ball cover may advantageously be utilized to make balls electrically conductive. According to another preferred embodiment of the invention, the non-fibrous, electric elements applied in fluid form, penetrating the cloth panels and appearing as rectangles, circles, hollow configurations, or lines on the surface of tennis balls are interconnected through said seam comprising an electrically conductive substance mixed with an adhesive. This conductive adhesive may cement the core ball to the cover panels, and also form the endless seam between the panels. The surface of the seam or the entire seam comprises a composite material containing a finely divided electrically conductive substance, such as carbon or silver. The material is applied between the panels in fluid form and set or cured to form at least the surface of the seam. Thus, both the electrically conductive, adhesive layer cementing the panels to the core ball and the seam ensure the electric connection of all of the leads on the playing surface of the ball making contact with the spaced electric leads provided on the ground within and outside the court area, as the ball touches the ground. The ball, in this manner, closes the circuits which are formed by said electric leads on the ground, the power source and the visual or audio signalling device.

According to another embodiment of the ball construction, the said seam is conductive, but the adhesive layer between the panels and the core ball is not electrically conductive. Thus, by utilizing only the seam between the cover cloth panels to interconnect the electric leads on the ball surface, the electrically conductive substances may be confined solely to the surface of the ball.

Paste-like compositions, solutions or emulsions of the polymeric binder serving as carrier for the finely divided, metallic or non-metallic, electrically conductive substance may, for instance, comprise butadiene-styrene rubber, polyvinyl chloride, polyethylene, polyurethane, polyester, urea, or acrylonitrile butadiene co-polymer and a phenolic resin. The electrically conductive material, which may comprise 80% by weight, or more, of the fluid composition, is added to the polymeric binder in finely dispersed form. The electrically conductive materials are selected from (a) the carbon and non-metallic group, which includes finely divided graphite, conductive carbon, carbon black, channel black, acetylene black, copper oxide, and/or (b) the metals group, which includes finely divided gold, silver, platinum, cobalt, steel, aluminum, copper, nickel and tungsten. Other conductive materials may also be used. The respective amounts of conductive material and polymeric binder in the composition depend on the color and conductivity of the material used, on the properties of the polymeric binder and the surfaces to which the composition is meant to adhere.

Tennis balls meeting the specifications prescribed by the International Tennis Federation and the United States Tennis Association are sold under such trade names as Bancroft, Dunlop, Goodall, Penn, Slazenger, Wilson and others. The lightest-colored balls are not always preferred by tennis players, as is demonstrated by the popularity of yellow tennis balls over pure white ones. Most of the balls supplied are yellow in color, some are orange or pink, and only a very small percentage of balls currently used is white.

Teeguarden et al. state in U.S. Pat. No. 3,039,773 that a ball, presumably white, having a colored seam appears perfectly white during flight irrespective of the color imparted to the seam. Playing tests conducted by applicant have demonstrated that yellow tennis balls having evenly spaced discrete dark blue, black or other dark configurations not exceeding 25% of the ball surface and not wider than approximately 10 millimeters, are at least as visible in flight against a green background, such as conventional curtains, as are balls without such markings and, importantly, that balls with such markings are more easily visible in flight to the players and to spectators against a light-colored court surface or background, into which uniformly light-colored tennis balls tend to blend. This is to say that dark markings on a ball used against a light background or on a light-colored court can actually improve the visibility of the ball in flight. Although applicant has not conducted actual visibility tests of balls made according to the present invention on television, there is reason to believe that tennis balls having the herein described markings, offer significantly improved visibility to spectators watching a televised match being played on a light-colored court.

Tennis balls made by the abovementioned manufacturers vary slightly in diameter and surface area; the approximate range of surface area is 11,500–12,500 square millimeters per ball. The above listed brands of tennis balls have imprinted thereon their trademarks and other words and symbols, normally in colored or black ink. Such dark imprints measuring overall up to 30×50 millimeters, have not been found to be interfering with the visibility of the ball.

According to an embodiment of the present invention, such imprints may comprise an electrically conductive substance and serve as electric leads. The surface area of these imprints may, depending on their configuration, be in addition to the total of 25% of the ball surface having a dark color.

If the conductive leads described hereinabove each have a discrete surface area of 25 square millimeters and are spaced 20 millimeters apart, the ratio of non-conductive surface to conductive surface on a tennis ball is approximately 20:1, the cumulative surface area of the conductive elements being approximately 5% of the total ball surface. I have found, for instance, that a tennis ball which has provided on its surface black markings, each marking occupying a discrete area of 25 square millimeters and separated from the nearest other such marking by 15 millimeters provides excellent visibility in play. Tables 1 and 2 list the approximate percentage of the total ball surface taken up by variously shaped, dark, electrically conductive leads and the perceived visibility of balls in flight having such leads.

TABLE 1

| Discrete Conductive Surface Leads | | | | |
|---|---|---|---|---|
| Configuration | Area | Spacing | Cumulative Area (percent of total ball surface) | Visibility in Flight |
| Rectangular or circular | 9 sq.mm | 20 mm | 2% | Excellent |
| | 9 | 10 | 5 | " |
| | 16 | 20 | 3 | " |
| | 16 | 12 | 6 | " |
| | 16 | 10 | 8 | " |
| | 25 | 20 | 5 | " |
| | 25 | 15 | 6 | " |
| | 25 | 10 | 11 | Good |
| | 100 | 20 | 11 | " |
| | 100 | 15 | 16 | " |
| | 100 | 10 | 25 | Fair |
| | 144 | 20 | 14 | " |
| | 144 | 15 | 20 | " |

TABLE 2

| Connecting Conductive Surface Leads | | | | |
|---|---|---|---|---|
| Configuration | Width | Spacing | Cumulative Area (percent of total ball surface) | Visibility in Flight |
| Lines intersecting at 90° | 2 mm | 20 mm | 17% | Good |
| Lines intersecting at 90° | 3 | 20 | 24 | Fair |
| Lines intersecting at 90° | 3 | 16 | 29 | Poor |
| Lines intersecting at 90° | 5 | 20 | 36 | " |

It should be understood that the results of the visibility tests shown in Tables 1 and 2 reflect the subjective judgement of applicant and other experienced tennis players who conducted playing tests against the background of green curtains commonly suspended from tennis court fences. The tests were conducted with conventional tennis balls having provided thereon black elements. It is applicant's judgement that discrete or defined dark markings on a tennis ball covering approximately ten percent of the ball surface, actually improve the visibility of a 100% yellow ball in flight, particularly against a light green or other light-colored court surface.

EXAMPLE 1

A tennis ball core is coated with a paste or mixture containing 50% conventional adhesive for the bonding of rubber and plastic and 50% electrically conductive material such as finely divided carbon. The mixture may also contain a catalyst to promote crosslinking of the polymeric components. Using this mixture, two conventional tennis ball fabric panels or segments comprising nylon and polyester fibers are cemented to the ball core according to conventional methods. The said mixture is sufficiently viscous so that it will not migrate or spread to the surface of the ball. The mixture may also, but need not, form the endless seam between the two panels. The fabric from which the panels have been cut has been prepared according to the following method.

Yarn made of electrically conductive carbon filaments having a diameter of 11 micron, sold by Union Carbide Corporation under the Thornel trade name, is woven into a nylon/polyester yarn fabric by the jacquard method in such a way that the conductive yarn is exposed on the outer and inner surface of the ball cover in the form of discrete electric leads each having a surface area of 16 square millimeters. The electric leads are spaced 12 millimeters apart. When the ball cover segments are cemented to the core ball, the carbon filaments exposed on the inner side of the fabric become embedded in the aforementioned conductive, adhesive layer, which thus interconnects the electric leads totalling approximately 45 in number on the entire ball cover and covering approximately 6% of its surface. Such a ball will have necessary conductivity; it will close the approximate electric circuits; it will have excellent visibility and, due to the pliability of the carbon filaments, it will have the same playing characteristics as a ball made without said carbon filament yarn.

EXAMPLE 2

An electrically conductive, adhesive composite formulation MH2429, sold by Johnson Matthey Inc., Wayne, PA, comprising 71% finely divided silver and an acrylic polymer is diluted with butyl acetate to reduce its viscosity, so as to be able to apply the substance in fluid form to a tennis ball cover fabric under pressure so that the fluid penetrates the fabric. The viscosity must, however, not be so low as to cause "bleeding" of the fluid substance on the outer fabric surface. The fluid is forced through the fabric prior to cutting it into panels through ink jet printers or similar means, or may be applied by conventional printing devices and methods, provided the fluid penetrates the fabric. The electric leads have the shape of discontinuous lines, each 20 millimeters long and spaced 20 millimeters apart. The leads, i.e. the lines have a width of approximately two millimeters on the playing surface of the fabric, but the conductive paste or fluid may spread towards the inside of the fabric facing the core ball. Following printing, the material is air-dried for 30 minutes and cured at 70° centigrade for 30 minutes. The panels cut from this fabric are cemented to a core ball with the same MH2429 formulation, which forms a conductive layer around the core ball contacting the abovementioned conductive paste or fluid penetrating to the inside of the cover cloth panels. A ball having panels cut from said fabric has a cumulative, relatively dark, conductive surface area of 17%, excellent visibility and normal playing properties. The said printed lines on the playing surface of the ball are interconnected only by the conductive coating which cements the panels to the core ball.

EXAMPLE 3

The uncut ball cover fabric is imprinted as in Example 2, with a conductive fluid in sufficient quantities and under sufficient pressure, such as through an ink jet printer, causing it to penetrate the fabric from one surface to the other. However, each line is long enough to extend to and contact the seam between the panels. The cut panels are joined to the core ball and to each other with an electrically conductive adhesive of the type used in Example 2. Thus, the endless seam between the panels and the layer cementing the panels to the core ball both are conductive and in this manner the lines forming the leads are electrically interconnected through the seam and through the coating between the core ball and the ball cover. This twofold electric connection can reduce the possibility of a malfunction due to lack of electric contact.

The methods described in Examples 2 and 3 may be further modified, for instance by changing the configuration of the lines forming the conductive leads on the ball. When the lines are long enough or deposited at an angle, so as to contact each other, the electric leads will be interconnected in a threefold manner (1) through intersection or direct contact, (2) through the conductive seam, and (3) through the conductive coating between the core ball and the panels.

When a ball manufactured in accordance with the Examples and having conventional wall thickness and compressibility makes contact with the ground, the wall segment of the ball touching the ground will flatten to a degree. A ball dropped vertically from a height of one meter will leave a "footprint" circular in shape, with a diameter of approximately 25 millimeters, thus ensuring the closing of the circuit of which the ball is a part and which comprises electric leads on the ground normally spaced 10–15 millimeters apart. A ball hit the length of a tennis court over a regulation net, will flatten at least as much and, on a clay court, will, due to skidding, leave an elongated "footprint" 25 millimeters wide and 25–50 millimeters or more in length.

If for instance, in accordance with the teachings of U.S. Pat. No. 4,092,634, spaced electric leads in the form of a plurality of parallel strips approximately 10 millimeters apart are provided on the ground, an electric lead on said flattened surface of the ball having a width or diameter of 20 millimeters or more, will bridge the gap of 10 millimeters between the parallel electric leads on the ground.

According to a preferred embodiment of the invention, the electric leads on the tennis ball surface take a shape of rings, i.e. hollow circles or configurations approximating circles, having overall dimensions large enough to span the distance between at least two electric ground leads of opposite charge. In practice the outside diameter of a ring will be in excess of 10 millimeters, for instance 20 millimeters. Such rings or closed loops have a width of 2 to 8 millimeters, and preferably 3 to 6 millimeters. A ball prepared in this manner will in all instances upon impact upon the ground close the circuit formed by the electric ground leads, the power source, necessary connections and the indicating or signaling device; the ball becoming part of said circuit upon impact.

According to another preferred embodiment, I print or otherwise apply a plurality of electric leads consisting of conductive ink or other conductive substances on the fabric forming the playing surface, such conductive substances tending to discolor the playing surface and therefore being limited in total area as herein before stated. Each lead has the shape of two or more discontinuous, intersecting lines. The length of said lines and their angle with each other are such that, irrespective of the orientation of such lead and of the direction in which said lines point at the moment the ball impacts on the ground, such electric lead contacts at least two electric ground leads of opposite charges, thus closing the circuit activating the indicating device. It follows that, the more widely spaced the electric ground leads, the longer said discontinuous, intersecting lines have to be. If the electric lead on the ball has the shape of a right-angled cross, the minimum length of the discontinuous lines is calculated as follows. Using L for the length of each of the lines forming the right-angled cross and D for the distance between ground leads, the following equation will give an adequate length of said lines: $L=D\times 1.5$.

Assuming as an illustration that the lines of the cross form a 45 degree angle with the ground leads when the ball impacts on the ground, the spacing of 11.3 millimeters between the ground leads forms the hypotenuse of a isosceles, right-angled triangle having two sides of approximately 8 millimeters each. Two such sides of 8 millimeters each form one line of said cross. Accordingly, the cross-shaped electric lead on the ball is formed by two intersecting lines of 16 millimeters length each, or preferably 20 millimeters, allowing a safety margin.

The leads on the ball may consist of three or more discontinuous, intersecting lines. The leads having said configurations are spaced on the ball in accordance with the dimensions of the flattened segment which may normally be expected to obtain upon impact of the ball on the ground. Assuming such a flat area of 25 millimeters in diameter, the cross-shaped leads on the ball will be spaced not more than 20 millimeters apart.

While this invention has been described in conjunction with the embodiments described herein, it is evident that many alternatives, modifications and variations will be apparent to those skilled in the art. Accordingly, the present invention is intended to embrace all alternatives, modifications and variations that fall within the spirit and scope of the appended claims.

What is claimed is:

1. A ball for use in ball game indicating systems comprising spaced electric ground leads forming part of a circuit intended to be closed by an impacting ball having conductive surface elements, such ball having requisite electric conductivity and high visibility in flight, comprising a. a flexible core ball, b. a flexible, electrically conductive, adhesive layer covering the core ball, c. a flexible cover cemented to the core ball by said adhesive layer, forming on its outside the playing surface of the ball, and d. a plurality of separate elements forming spaced electric leads comprising a dark-colored, electrically conductive substance on not more than 25% of the playing surface of the ball, wherein i. each lead has a defined shape and a width of at least 2 millimeters, ii. the leads are spaced so that on the playing surface of the ball no lead is separated from the next nearest lead by more than 20 millimeters, iii. The leads penetrate and are exposed on the inner surface of said cover, and iv. the leads contact the conductive layer cementing the core ball to the cover, so that the said leads on the playing surface of the ball are electrically interconnected between the inner surface of the cover and the core ball and so that two such leads touching the ground connect two electric ground leads at the moment of impact of the ball.

2. A ball for use in court and ball game indicating systems comprising spaced electric ground leads forming part of a circuit intended to be closed by an impacting ball having conductive surface elements, such ball having requisite electric conductivity and high visibility in flight, comprising a. a flexible core ball with a diameter of 55–65 millimeters, b. a flexible, adhesive layer covering said core ball, c. a plurality of fibrous panels forming on their outside the playing surface of the ball cemented to the core ball by said adhesive layer, d. a seam between said panels, said seam having an electrically conductive surface, and e. a plurality of separate elements forming spaced electric leads on not more than 25% of the playing surface of said panels, said leads i. comprising a dark-colored electrically conductive substance, ii. having a defined shape and a width of at least 2 millimeters, iii. being spaced so that on the playing surface of the ball no lead is separated from the next nearest lead by more than 20 millimeters, and iv. extending to and contacting said conductive seam on the playing surface of the said panels so that said leads are electrically interconnected on the playing surface of the ball and so that two such leads touching the ground connect two electric ground leads at the moment of impact of the ball.

3. A ball for use in court and ball game indicating systems comprising spaced electric ground leads forming part of a circuit intended to be closed by an impacting ball having conductive surface elements, such ball having requisite electric conductivity and high visibility in flight, comprising a. a flexible core ball with a diameter of 55–65 millimeters, b. a flexible, electrically conductive, adhesive layer covering the core ball, c. a plurality of fibrous panels forming on their outside the playing surface of the ball cemented to the core ball by said adhesive layer, d. a seam between said panels, said seam having an electrically conductive surface, and e. a plurality of separate elements forming spaced electric leads on not more than 25% of the playing surface of said panels, said leads i. comprising a dark-colored, electrically conductive substance, ii. having a defined shape with a width of not less than 2 millimeters, iii. being spaced so that on the playing surface of the ball no lead is separated from the next nearest lead by more than 20 millimeters, iv. penetrating and being exposed on the inner surface of said panels, v. contacting the conductive layer cementing the core ball to said panels, and vi. extending to and contacting said conductive seam on the playing surface of said panels, so that the electric leads on the playing surface of the ball are electrically interconnected on said playing surface and between the inner surface of said panels and the core ball and so that two such leads on the ball surface touching the ground connect two electric ground leads at the moment of impact of the ball.

4. The ball of claims 1, 2 or 3, wherein the electric leads comprise carbon-based, electrically conductive yarns, continuous filaments or discontinuous fibers.

5. The ball of claims 1, 2 or 3, wherein the electric leads comprise an electrically conductive substance applied to said panels in fluid form and solidified.

6. The ball of claim 5, wherein the electrically conductive substance forming the electric leads comprises a composition consisting of a finely divided, electrically conductive material dispersed in a polymeric binder and applied to said panels in fluid or paste-like form and set or cured.

7. The ball of claim 6, wherein the electrically conductive material consists of non-metallic material selected from the group including conductive carbon, carbon black, channel black, acetylene black and graphite.

8. The ball of claim 7, wherein the electrically conductive material consists of metals selected from the group including copper, silver, cobalt, steel, aluminum and nickel.

9. The ball of claims 1, 2 or 3, wherein the electric leads have discrete, two-dimensional, geometric shapes and have outside dimensions large enough to span the distance between two electric ground leads.

10. The ball of claims 1, 2 or 3, wherein the electric leads have the shape of discontinuous lines.

11. The ball of claims 1, 2 or 3, wherein the electric leads have the shape of a grid formed by intersecting lines.

12. The ball of claims 1, 2 or 3, wherein the electric leads have the configuration of at least two discontinuous, intersecting lines having a width of 2–8 millimeters and sufficient length so that at least one such line spans the distance between two electric ground leads, irrespective of the orientation of the lead on the ball surface with respect to said ground leads at the moment of impact of the ball.

13. The ball of claims 1, 2 or 3, wherein the electric leads comprise discontinuous, electrically conductive fibers inserted into the ball cover.

14. The ball of claims 1, 2 or 3, wherein the electric leads comprise discontinuous, electrically non-conductive fibers coated with an electrically conductive substance and inserted into the ball cover.

15. A ball for use in ball game indicating systems comprising spaced electric ground leads forming part of a circuit intended to be closed by an impacting ball have electrically conductive surface means, such ball having requisite electric conductivity and high visibility in flight, wherein a. at least 75% of the playing surface of the ball is light-colored, and b. electrically conductive means forming spaced electric leads have been provided on not more than 25% of the playing surface of the ball, said electric means i. comprising dark-colored, electrically conductive material, ii. having a defined shape and a width of at least 2 millimeters, iii. extending on essentially only the playing surface of the ball, iv. not being electrically connected substantially below the playing surface of the ball, v. being spaced so that on the playing surface of the ball no lead is separated from the next nearest lead by more than 20 millimeters, and vi. the electrically conductive means forming said leads having overall dimensions so that any one of said means on the playing surface of the ball will connect two ground leads upon contact of the partially flattened ball with the ground.

16. The ball of claim 15, wherein the electrically conductive means are formed of finely divided, electrically conductive material.

* * * * *